US009861546B2

(12) United States Patent
Fenton et al.

(10) Patent No.: US 9,861,546 B2
(45) Date of Patent: Jan. 9, 2018

(54) BODY CONTAINMENT CONSTRUCTION SUITABLE FOR USE WITHIN BIO-CREMATION PROCESSES

(71) Applicant: KRS, LLC, Prescott, WI (US)

(72) Inventors: Renata Fenton, Lake Elmo, MN (US); Anne Sofie Lefèvre, Copenhagen (DK)

(73) Assignee: KRS, LLC, Prescott, WI (US)

( * ) Notice: Subject to any disclaimer, the term of this patent is extended or adjusted under 35 U.S.C. 154(b) by 0 days.

(21) Appl. No.: 15/452,147

(22) Filed: Mar. 7, 2017

(65) Prior Publication Data

US 2017/0172833 A1 Jun. 22, 2017

Related U.S. Application Data

(62) Division of application No. 14/304,426, filed on Jun. 13, 2014, now Pat. No. 9,597,249.

(Continued)

(51) Int. Cl.

| | |
|---|---|
| ***A61G 17/06*** | (2006.01) |
| ***A61G 17/00*** | (2006.01) |
| ***A61G 17/007*** | (2006.01) |

(52) U.S. Cl.

CPC ..... *A61G 17/06* (2013.01); *A61G 17/00* (2013.01); *A61G 17/004* (2016.11);

(Continued)

(58) Field of Classification Search

CPC ..... A61G 17/00; A61G 17/007; A61G 17/06; A61G 17/004; A61G 2203/90; B09B 3/00;

(Continued)

(56) References Cited

U.S. PATENT DOCUMENTS 4,139,929 A 2/1979 Angermann
4,780,940 A * 11/1988 Jay ..... A61G 17/007 27/2

(Continued)

FOREIGN PATENT DOCUMENTS

GB 2465618 A 6/2010
WO 2011013735 11/2011

OTHER PUBLICATIONS

Cardia bioplastics, "Cardia Compostable B-F," http://www.cardiabioplastics.com/uploads/110317_CBP_TECHNICAL_DATA_SHEET_-_Compostable_B-F_V3.pdf, printed Jun. 11, 2013, (2 pages).

(Continued)

*Primary Examiner* — William Miller
(74) *Attorney, Agent, or Firm* — Kagan Binder, PLLC

(57) ABSTRACT

Body containment constructions, materials, and methods of use for bio-cremation processes are disclosed. Preferably, the containment constructions of the present invention provide the functionality of liquid containment and also the functionality of body presentment for viewing purposes, if desired, in addition to bio-degradability. Advantageously, liquid containment is provided in a body containment construction that is sufficiently liquid impervious, allows for body transport by sufficient structural support, and is decomposable within the time period for a bio-cremation process. More preferably, the containment construction will dissolve or decompose within a normal procedural time period without leaving any component remaining from the containment construction. According to an aspect of the present invention, a body containment bag is provided that is made from a structural material that is combined with a liquid containment material and one or more closures, wherein the body containment bag is effectively usable for bio-cremation during which all components of the body containment bag (Continued)

can effectively decompose by alkaline hydrolysis. Methods of making and of utilizing a body containment bag for decomposition are also disclosed.

6 Claims, 12 Drawing Sheets

Related U.S. Application Data

(60) Provisional application No. 61/834,559, filed on Jun. 13, 2013.

(52) U.S. Cl.
CPC ..... *A61G 17/007* (2013.01); *A61G 2203/90* (2013.01); *Y10T 29/49826* (2015.01)

(58) Field of Classification Search
CPC .... B09B 5/00; B65D 33/065; B65D 33/2508; B65D 33/2591; B65D 88/22; B65D 33/06; B31B 19/90; Y10T 29/49826
USPC ..... 27/28; 241/1, 301; 383/66, 98, 6, 16; 493/186, 212, 267; 588/318; 29/428
See application file for complete search history.

(56) References Cited

U.S. PATENT DOCUMENTS

| | | | | |
|---|---|---|---|---|
| 4,790,051 | A * | 12/1988 | Knight | A61G 1/01 27/28 |
| 7,484,275 | B2 * | 2/2009 | Carroll | A61G 17/007 27/28 |
| 8,966,726 | B2 * | 3/2015 | Chua | A61G 17/06 27/28 |
| 9,216,128 | B2 * | 12/2015 | Richardson | A61G 17/06 |
| 2003/0046798 | A1 | 3/2003 | Valles Camps et al. | |
| 2006/0222574 | A1 | 10/2006 | Kaye et al. | |
| 2007/0009185 | A1 * | 1/2007 | Lee | A61G 17/06 383/16 |
| 2009/0007402 | A1 | 1/2009 | Carroll et al. | |
| 2010/0213292 | A1 | 8/2010 | Sullivan | |
| 2013/0053615 | A1 | 2/2013 | Wilson et al. | |

OTHER PUBLICATIONS

Keijzer et al., "TNO-060-UT-2011-001432 Environmental impact of different funeral technologies," Aug. 8, 2011, (88 pages).

* cited by examiner

BODY CONTAINMENT CONSTRUCTION SUITABLE FOR USE WITHIN BIO-CREMATION PROCESSES

CROSS-REFERENCE TO RELATED APPLICATIONS

This application is a divisional application of U.S. patent application Ser. No. 14/304,426, filed Jun. 13, 2014, now allowed, which claims the benefit of U.S. Provisional Patent Application No. 61/834,559, filed Jun. 13, 2013 the entire contents of which are incorporated herein by reference in their entirety.

TECHNICAL FIELD

The present invention is directed to a receptacle or bag that is sized and shaped for containing and transporting human remains, and more particularly to such a bag that is suitable for liquid containment, body presentation, and that will decompose within the time constraints of bio-cremation processes.

BACKGROUND

Disposal of human remains is quickly becoming more challenging throughout the world based upon concerns of land usage and environmental impact. Burial in cemeteries requires more and more space, which space can be very expensive in populated areas such as within large cities. Also, burial processes utilize resources such as wood, metals, and plastics, which take away from other potential usages of these materials. Moreover, burial processes utilize embalming fluids, such as formaldehyde and methyl alcohol, which fluids may eventually be released into the ground. These chemicals are generally considered to be toxic and polluting to the environment.

Cremation by burning human remains, on the other hand, solves the problem of using more and more space for the human remains to be buried. Cremation is perceived as more environmentally friendly and convenient. However, cremation by burning human remains is actually environmentally unfriendly due to the pollution to air from the cremation emissions. Such emissions include nitrogen oxides, carbon monoxide, sulphur dioxide, particulate matter, mercury, hydrogen fluoride, hydrogen chloride, and heavy metals. In some parts of the world, it is estimated that cremation by burning bodies contributes more that ten percent of the mercury pollution within the air.

It is increasingly more difficult to build additional crematoriums because of the environmental backlash. Cities are banning further constructions due to the environmental concerns even though the demand for cremation is increasing. This increased demand is largely based upon cost since burial plots are not needed and the purchase of expensive caskets and the like can potentially be avoided.

More recently, another cremation technology has been developed that is known as alkaline hydrolysis. This technology has been in use for some time, such as by institutions that deal with bodies that have been donated to science and the like. This process is considered to be more environmentally friendly or "green" than a cremation by burning process in that toxins, as noted above, are not released into the air environment. An alkaline hydrolysis process biochemically hydrolyzes all of the human tissue leaving only the bone fragments behind.

Specifically, the process utilizes a disposition chamber, which comprises a vessel of a size sufficient for a body to be supported within an interior chamber. The vessel includes a door that is sized as well to allow a human body to pass and that also is sealable to the vessel so as to be water tight. Such a chamber includes necessary plumbing for water and chemicals, in particular potassium hydroxide, to be supplied into and circulated within the vessel, and to allow for liquid removal from the vessel. A system for heating the water mixture within the vessel is also provided. A system for pressurizing of the vessel is also provided, whereas the pressurization allows the water mixture to be heated above boiling temperature without boiling. Such systems are fully automated. Within the vessel, a body support can comprise a retaining basket that is capable of supporting a body during the process and from which the skeletal remains can be recovered. Disposition chambers, as above, are commercially available from Resomation Ltd. of Glasgow, Scotland as well as from Matthews Cremation Division of Matthews International Corporation of Pittsburgh, Pa.

A bio-cremation process typically entails loading a body into the disposition chamber followed by exposing the body to water and potassium hydroxide that is heated to around 160 degrees Celsius while the vessel is pressurized to prevent boiling for about three hours. During this exposure, the body tissues are all effectively dissolved into its chemical components, leaving what is known as "bone shadows" or bone ash, which comprises soft porous white bone material that is calcium phosphate. This bone material is then dried and pulverized as the body remains.

After a body is processed, the liquid that includes the alkaline water and dissolved organic material (containing amino acids, peptides, sugars and salts) is drained from the vessel. This liquid can be easily contained so as to provide a much "greener" process that a burning process where airborne emissions are released. Disposal and management of the liquid can be controlled so that the water can be effectively treated and ultimately released back into the environment.

The alkaline hydrolysis process dissolves protein-based materials. Moreover, it is desirable not to add anything to the process that hinders the process or is not dissolved in the process. It is, however, needed to contain the body within something to transport the body to the disposition chamber and to go with the body into the chamber. With cremation processes by burning, a wooden casket serves such purpose well. With bio-cremation, another approach is needed. One developed approach utilizes a metal structure that is reusable along with a silk covering. Silk, being protein based, can decompose during the bio-cremation process, and the metal can be recovered and used again.

SUMMARY OF THE PRESENT INVENTION

The present invention is directed to body containment constructions, materials, and methods of use for bio-cremation processes. Preferably, the containment constructions of the present invention provide the functionality of liquid containment and also the functionality of body presentment for viewing purposes, if desired, in addition to bio-degradability. Advantageously, liquid containment is provided in a body containment construction that is sufficiently liquid impervious, allows for body transport by sufficient structural support, and is decomposable within the time period for a bio-cremation process. More preferably, the containment construction will dissolve or decompose within a normal procedural time period without leaving any component remaining from the containment construction.

According to an aspect of the present invention, a body containment bag is provided that is made from a structural material that is combined with a liquid containment material and one or more closures, wherein the body containment bag is effectively usable for bio-cremation during which all components of the body containment bag can effectively decompose by alkaline hydrolysis.

Preferably, the body containment comprises a layer of structural material and a separate layer of liquid containment material that are overlayed to one another with the structural layer being external to the liquid containment layer. The liquid containment material is preferably formed to create a head pocket, at least one side pocket, and a feet pocket for receiving a head, side, and feet of a body, respectively when positioned within the body containment bag. A plurality of closures are preferably positioned about at least a portion of the periphery of the structural layer, wherein each closure can be independently closed to close off a portion of the body containment bag. The layer of structural material can be laminated to the layer of liquid containment material.

According to one construction, a body containment bag can comprise a generally rectangular bottom panel with a head panel, side panel and feet panel provided along three edges of the bottom panel to create a head pocket, a side pocket and a feet pocket. Plural cover panels can be connected adjacent to one another along a fourth edge of the bottom panel opposite to the edge connected with the side panel with at least one overlap portion of one panel that overlaps a portion of another panel, the overlap portion being unattached to the bottom panel. Additional cover panels can be provided connected to the side panel so as to cover a body from an opposite side than the plural cover panels connected to the fourth edge of the bottom panel to allow for better body presentation.

According to another construction, a body containment bag can comprise plural strip layer portions as the layer of structural material that are connected with the layer of liquid containment material and positioned so as to extend along at least one side edge and across a body support region of a bottom panel of the body containment bag for body support for transport. Preferably, plural strip layer portions form a criss-cross pattern across the bottom panel of the body containment bag and are connected with edge strip layer portions at corners of the body containment bag and forming loop handles at the corners of the body containment bag.

According to another aspect of the present invention, a method of making a body containment bag includes the step of combining a structural material with a liquid containment material for creating an interior space for body and liquid containment, wherein the body containment bag is effective for supporting and transporting a body, and the step of adding one or more closures to the body containment bag, wherein all components of the body containment bag can effectively decompose by alkaline hydrolysis.

According to yet another aspect of the present invention, a method of using a body containment bag that comprises a structural material combined with a liquid containment material and one or more closures, wherein the body containment bag is effectively usable for bio-cremation during which all components of the body containment bag can effectively decompose by alkaline hydrolysis, includes the steps of positioning a body within the body containment bag, closing the body containment bag utilizing at least one closure, and decomposing the body and body containment bag by alkaline hydrolysis. The method may also include a step of manipulation one or more portions of the bag to expose one or more body parts for presentation of the body after positioning the body within the body containment bag but prior to decomposition.

DETAILED DESCRIPTION OF PREFERRED EMBODIMENTS OF THE PRESENT INVENTION

The present invention is directed to provide body containment constructions, materials, and methods of use for bio-cremation processes. Preferably, the containment constructions of the present invention provide the functionality of liquid containment and also the functionality of body presentment for viewing purposes, if desired. In a basic construction, liquid containment is provided in a body containment construction that is sufficiently liquid impervious, allows for body transport by sufficient structural support, and is decomposable within the time period for a bio-cremation process. More preferably, the containment construction will dissolve or decompose within a normal procedural time period without leaving any component remaining from the containment construction.

Figure 1:
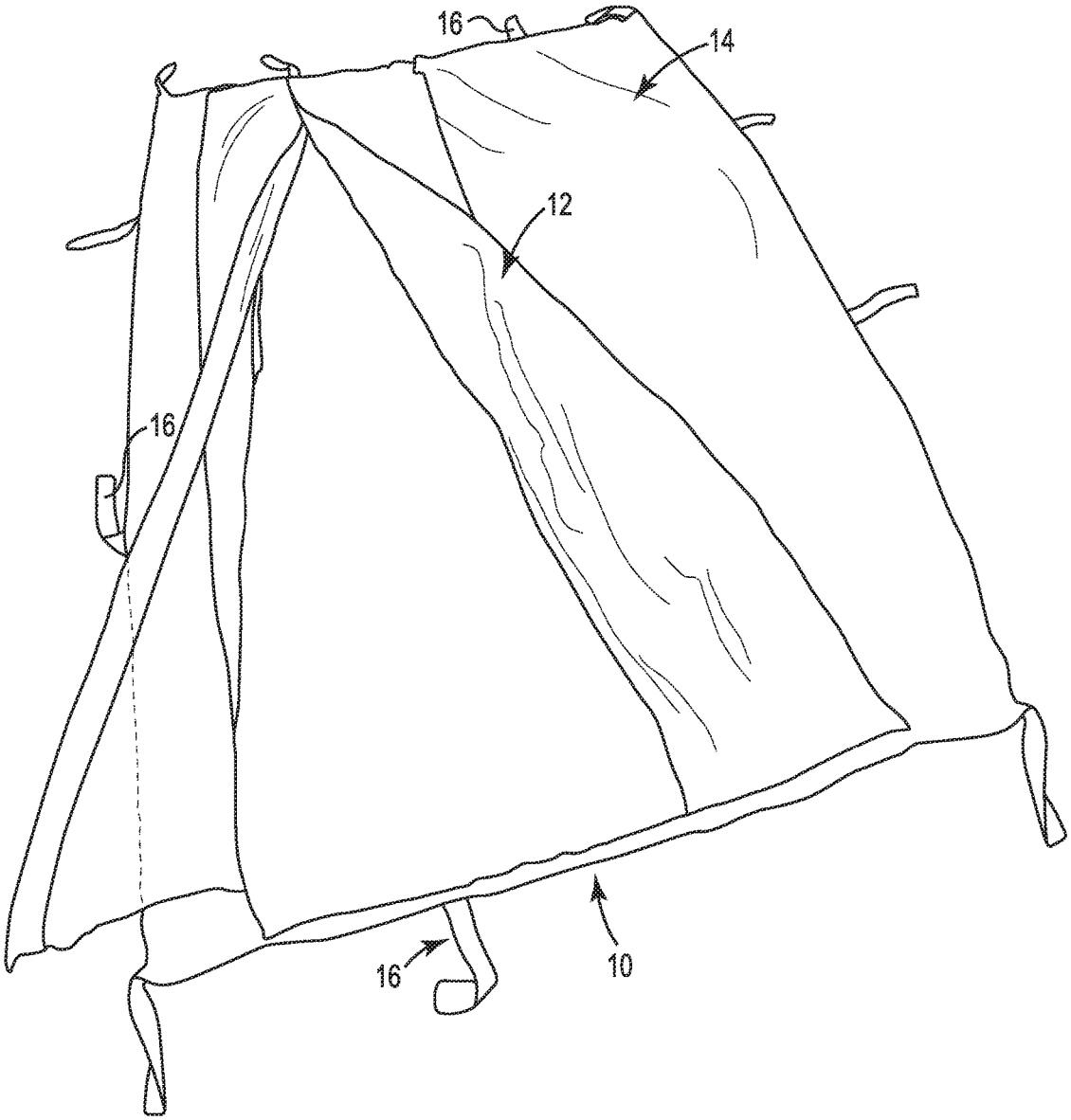
FIG. 1 is a perspective view of a body containment bag showing a construction including a liquid containment layer, a structural layer and multiple closure devices.

With reference to FIG. 1, the present invention is directed to a body containment bag 10 that is constructed with a liquid containment layer 12, a structural layer 14, and at least one closure device 16 for body transport ability and containment for a period of time without leakage. Importantly also in accordance with the present invention the containment bag 10 also is fully decomposable within a bio-cremation process, preferably within the normal processing conditions and time constraints as described above within the Background section.

In FIG. 1, an embodiment is illustrated wherein the liquid containment layer 12 is an internal layer of the construction with an external structural layer 14 that gives the bag construction sufficient strength for body transport. It is preferable, based upon accepted human body bag expectations, that the construction will support a weight of 280 kg without losing impermeability or support ability. The liquid containment layer 12 should similarly be able to prevent permeation of liquid for at least three days and up to a week. Preferably, the construction can contain up to 400 ml of liquid for a 36 inch by 90 inch (90 cm by 229 cm) area of the material construction.

For the supporting structural layer 14, a fabric layer is preferable, such as a woven or non-woven fabric that is made of organic, and more particularly, protein-based or starch-based fibers that will effectively decompose in an alkaline solution under bio-cremation conditions. Examples of protein-based fibers include wool, or silk that can be tightly woven in order to comply with the above structural and decomposable parameters as well as leathers, which also comply with structural and decomposable needs. The thickness or weight of the fabric is chosen based upon a balancing of the need for structural strength with the ability to decompose within the time constraints of a bio-cremation process. According to the present invention, a preferable thickness range for the structural fabric layer is based upon the strength requirements for the supporting layer primarily. With the use of decomposable structural layers, an alkaline hydrolysis process can easily decompose even very thick layers within the requisite time, so thickness is not an issue. Any structural material that is presently known or developed that will hydrolyze within the temperature, pressure and pH conditions of a bio-cremation process (discussed above) by way of alkaline hydrolysis is contemplated to be useful in accordance with the present invention. A preferred fabric comprises a wool gabardine weave that is tightly woven with a diagonal weave and of 100% pure virgin worsted wool. Such fabric is sufficiently durable for structure and retains a soft drape. Garbardine fabric is also naturally water repellant.

It is also understood that the structural layer 14 may comprise any number of layers, so long as the above-noted requirements are met with respect to strength needs and decomposition needs. Such layers can be laminated with one another by any well-known technique or otherwise attached by stitching them together, or the layers can be simply overlayed one-to-another. Dark colors are preferred for the fabric to avoid visible staining, and non-toxic dyes are also preferred that do not bleed or stain when in contact with hot water. The structural layer 14 functions to provide the requisite support and strength requirements, as noted above, and preferably also provides durability, body cover appropriately, stain repellency, liquid absorption and an ability to be handled for transport, such as including handles or the like as also discussed herein. Other preferred constructions are discussed below.

As to the liquid impermeable layer 12, water or liquid impermeability is important; however, breathability of the material layer is not an important factor. Resin films (whether of polymeric or oligomeric) of one mil in thickness or less are suitable for this purpose; however, compostable resin films of such thickness can be utilized in accordance with the present invention. For purposes of this invention, compostable means that such a resin layer is decomposable within an alkaline hydrolysis bio-cremation process as described within the Background section above. Suitable compostable plastic films include those that are starch-based, such as the Cardia Compostable BF films as are commercially available from Cardia Bioplastics of Blaine, Washington, U.S.A. A preferred film is a blown film resin identified as Cardia Compostable B-F film, which is a biodegradable and compostable resin material that is based on a blend of thermoplastic starch (TPS), biodegradable polyesters and natural plasticizers. This grade of resin is compatibilised to offer a high level of mechanical strength, elongation properties and toughness. The resin is derived from renewable resources including non-GMO corn starch which is an annually renewable resource. However, any liquid (water) impermeable resin or polymeric material that is presently known or developed that will hydrolyze within the temperature, pressure and pH conditions of a bio-cremation process (discussed above) by way of alkaline hydrolysis is contemplated to be useful in accordance with the present invention.

Specifically, the liquid impermeable layer 12, such as a compostable resin material, whether provided as a film or a coating, should decompose along with a structural layer 14, such as comprising a wool or silk fabric, when subject to a mixture of water and an alkaline material such as potassium hydroxide, the mixture being at a pH of between 11 and 12 and at between 160 and 180 degrees celcius. The decomposition based upon alkaline hydrolysis of the body bag 10 along with all body tissues is expected within two to three hours under normal processing conditions. For purposes of the present invention, it has been found that by keeping the thickness of the liquid impermeable layer 12 below one mil, complete decomposition is easily accomplished under normal operating controlled conditions without any remaining residue present within a disposition chamber. The liquid impermeable layer preferably functions to not only provide for effective and adequate liquid containment, as discussed above, but also for biohazard containment, and as an odor barrier.

The constructions according to the present invention may include multiple layers, as above with layers 12 and 14, which act together to provide desired functionality of a body bag 10 for bio-cremation. Any number of layers are contemplated, which layers can be overlaid without connection to one another, or may be partially connected together such as by stitches or the like, or may be fully laminated with one another. With a resin layer for liquid impermeability, as discussed above, that is also thermoplastic, a lamination process can be easily facilitated. Rolling a support fabric like wool or silk under heat and pressure with a thermoplastic and compostable resin layer will effectively produce a suitable laminated material. For example, a resin layer can be laminated to one side of a structural support layer by the application of sufficient heat and pressure. Or, a resin layer could be similarly laminated between structural support layers. Such a construction could allow for usage of multiple thinner structural support layers. Any number of layers are contemplated with the preference that all the layers will be effectively hydrolyzed within a bio-cremation process under conditions discussed above.

Figure 2:
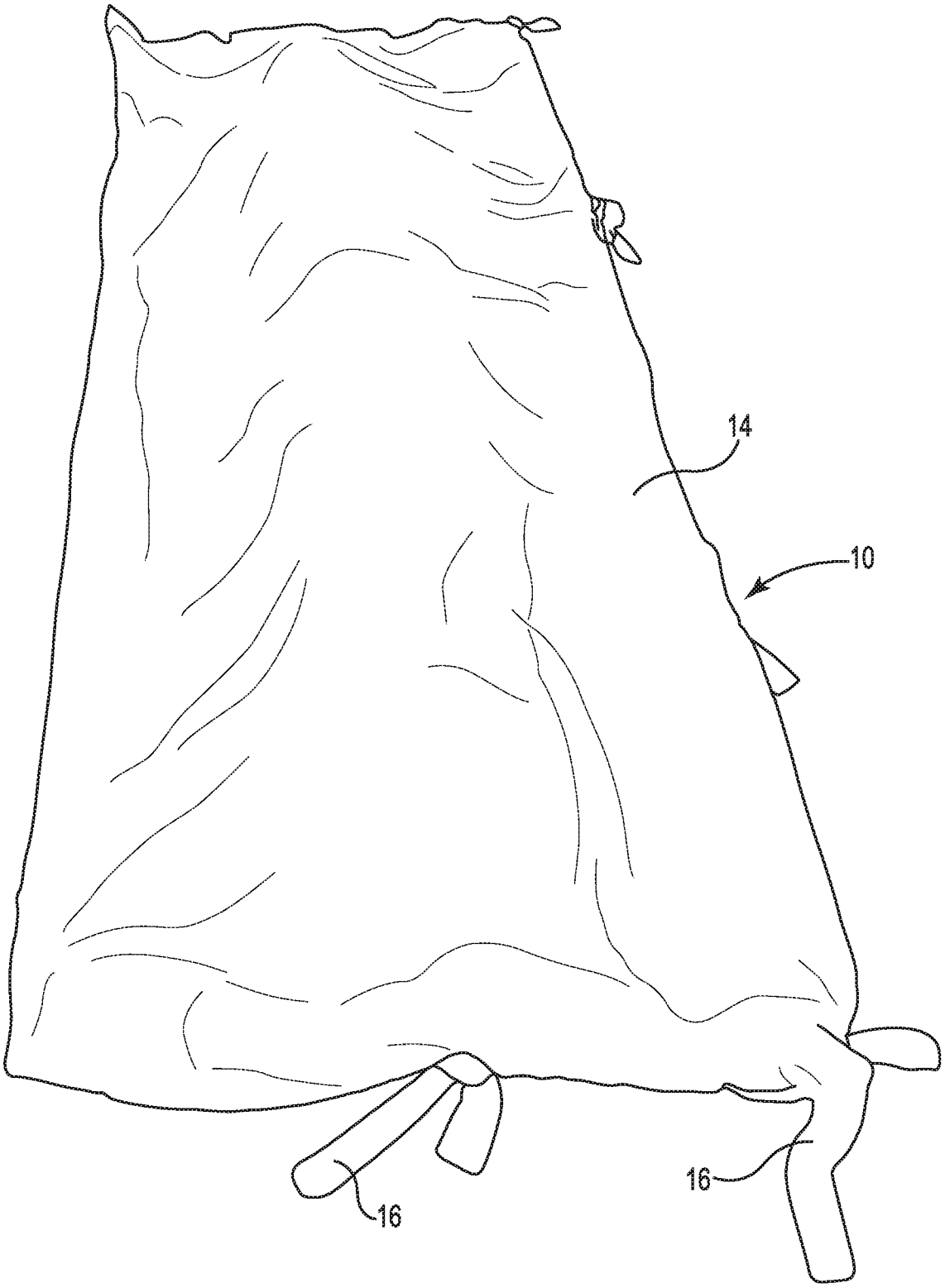
FIG. 2 is perspective view of the body containment bag of FIG. 1 with the body containment bag closed and covering a body and with the multiple closure devices in closing positions.
Figure 3:
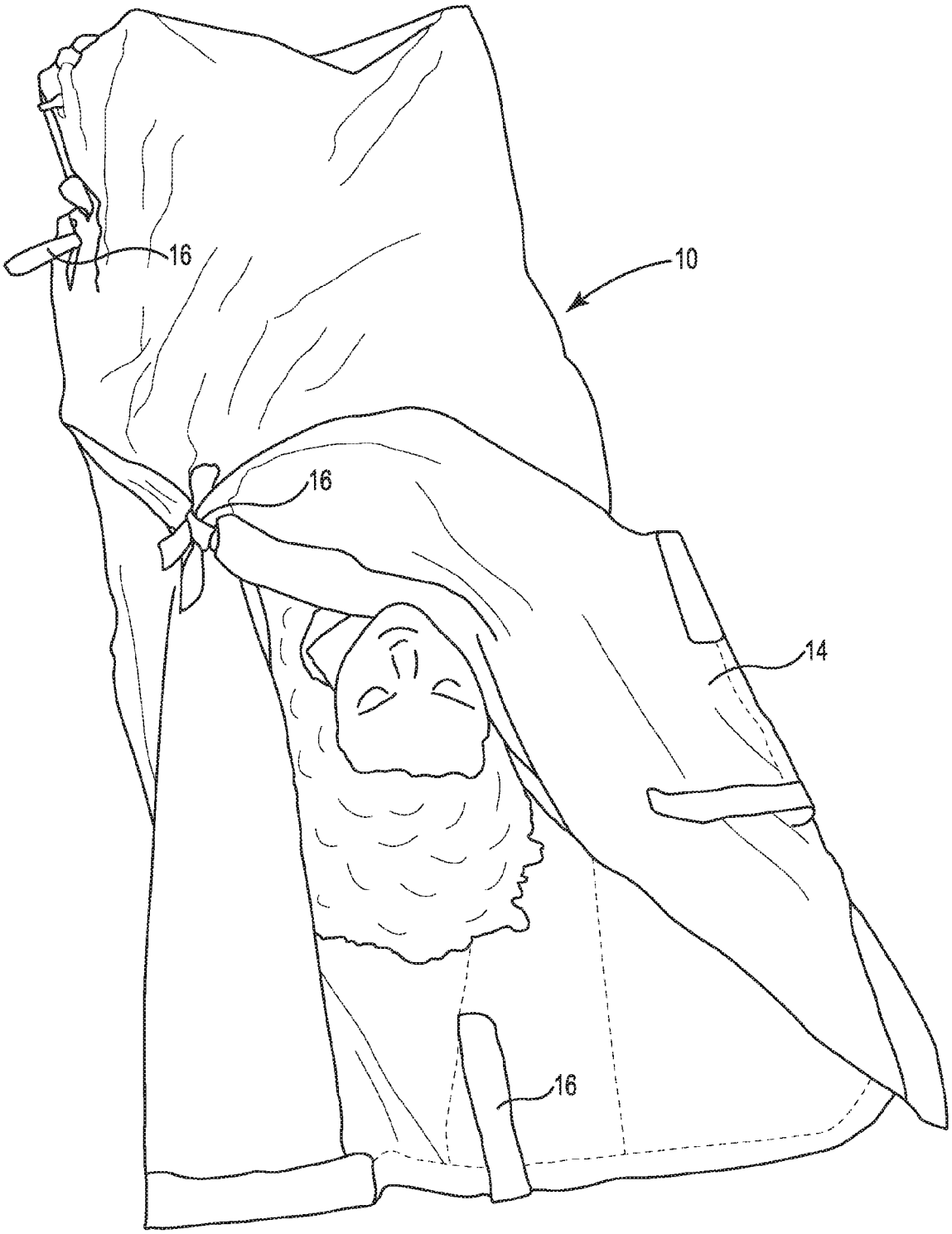
FIG. 3 is a perspective view of the body containment bag of FIGS. 1 and 2 with a portion of the bag and certain closures manipulated in order to expose a portion of a body for presentation.

Another aspect of the present invention is the provision of one or more closures to be effective to close the body containment bag 10 and thus contain any liquids and allow for human body transport. In the embodiment of FIGS. 1-3, closures 16 comprise straps that are connected, such as by sewing, adhesive or thermal bonding, with the structural layer 14 as such straps are strategically provided about the periphery of the bag 10 to effectively close the bag 10. It is preferable that the bag 10 be effectively closed about its perimeter either by seam construction or by one or more closures to enable body transport and liquid containment. Liquid containment is also facilitated by certain construction techniques, as also discuss below. In the case of closures 16 that comprise straps, the straps can be tied together to effectively close the bag 10 for these purposes. An advantage to the use of straps that themselves comprise the same material of the structural layer 14 is that they will decompose at the same time and rate as the structural layer 14.

In accordance with the present invention, it is preferred that all materials of the body containment bag 10 completely decompose within the parameters of an alkaline hydrolysis bio-cremation process. It is, however, contemplated that other components could be provided that would be recovered after the bio-cremation process, much in the same manner as medical implants are recovered. For example, a closure could comprise one or more metal components or the like that can be recovered and potentially reused. With respect to effectively decomposable other components, such as could be used in making closures like a zipper, starch-based resins are also contemplated. Again, any material and component design that can effectively hydrolyze within the constraints of the bio-cremation process could be utilized. For a component, such as a zipper closure or otherwise, the components would need to be designed thin enough to decompose within the time period for bio-cremation. Resin made snaps, buttons, and other resealable zip-type closures, as well as others of similar nature are contemplated provided that they can be made thin enough or of a material that decomposes sufficiently rapidly to be useful in accordance with the present invention.

FIG. 3 also illustrates a preferred aspect of body containment bags 10 of the present invention, body presentation. Just prior to cremation, it is desirable to be able to view one or more portions of a body for final visitation and identification purposes. Typically, visitors might wish to view the head area of a deceased person for these purposes. Other body parts are sometimes also viewed like a hand, for example. FIG. 3 shows how a head presentation could be done simply by having properly place closures open and with proper folding of flexible bag material portions. It is noted that it is desirable for head and/or hand presentation to show only the head or hands while covering the rest of the body as the remaining body is typically unclothed.

Figure 4:
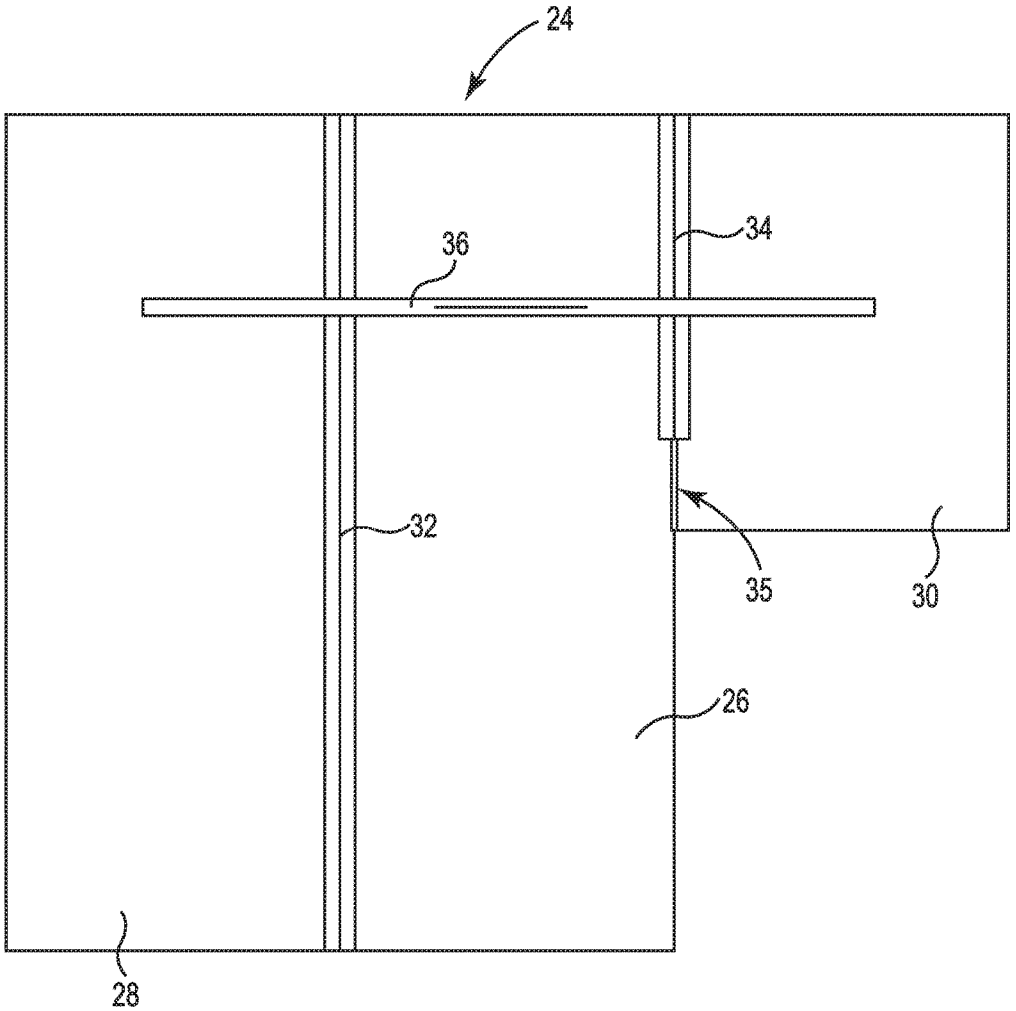
FIG. 4 is top plan view of a construction of a structural layer for a body containment bag of the present invention.
Figure 5:
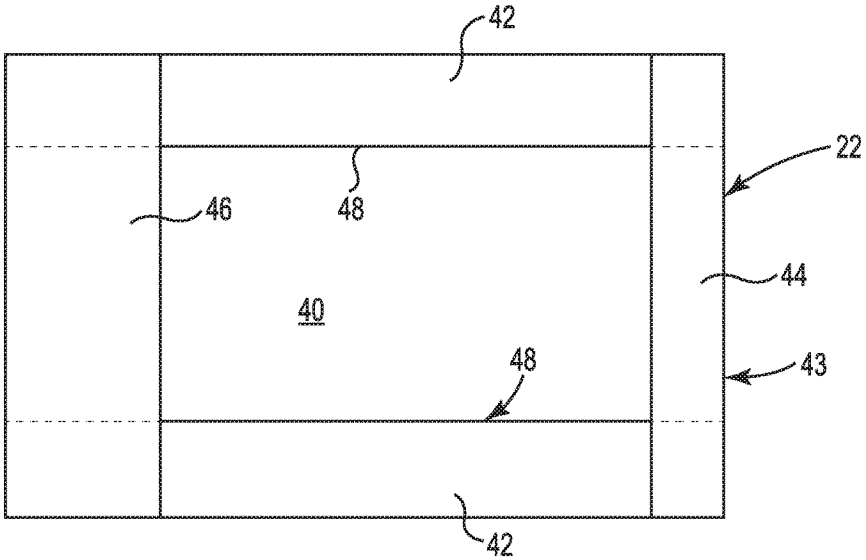
FIG. 5 is a top plan view of a construction of a liquid containment layer for a body containment bag of the present invention prior to folding.
Figure 6:
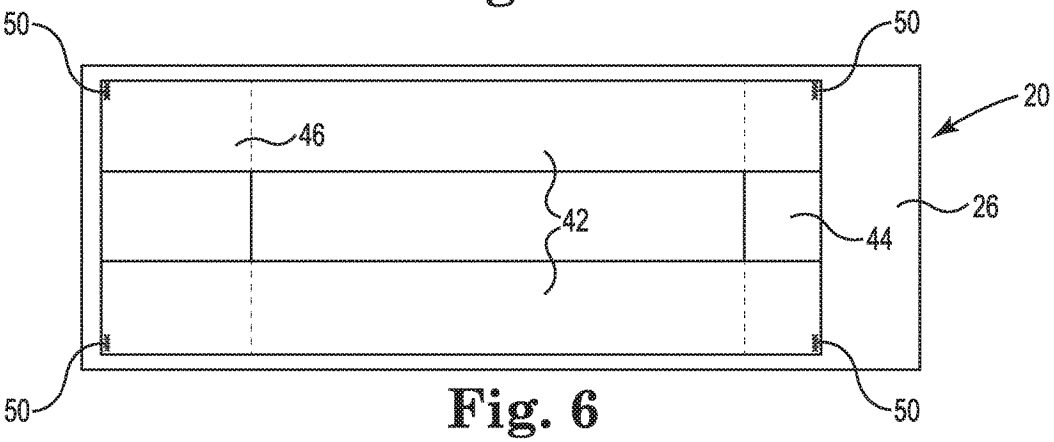
FIG. 6 is a top plan view of the construction of a liquid containment layer of FIG. 5 after folding of side portions of the layer over portions of the bottom portion of the layer.

A specific embodiment of one version of a body containment bag 20 is shown in FIGS. 4-6, where FIG. 4 illustrates a structural layer 24 and FIG. 5 illustrates a liquid containment layer 22. The structural layer 24 is shown as comprising plural elements, a bottom portion 26, a cover portion 28 and a flap portion 30, where the portions are sewn together along seam lines 32 and 34. In this embodiment, the bottom portion 26 and cover portion 28 are sized to define the body containment bag size and the flap portion 30 is utilized to facilitate a modest head presentation as discussed below. The seams 32 and 34 also create fold lines for the bag, it being understood that any one or more of the portions can be made with any other portion(s) so that sewing is unnecessary. A body strap 36 is also preferably provided that can be attached to the bottom portion 26 (such as by sewing, adhesive or thermal bonding), which body strap 36 can be used to tie in front of a deceased person's chest for holding the shoulders and chest in position for presentation and to prevent body movements during transport. By this construction, an upper corner of the cover portion 28 can be triangularly folded (like that shown in FIG. 3) for presentation of a head while the flap portion 30 could be similarly folded underneath the cover 28. This leaves the head exposed while covering both shoulders from either side for better modesty in the presentation. Also, lower non-seamed edges at 35 below seam 34 and between the flap portion 30 and the bottom 26 can facilitate the extension of a hand through the bag for presentation of a hand.

FIG. 5 shows a resin layer usable as a liquid containment layer 22. The layer 22 includes a bottom portion 40, two side portions 42, a foot portion 44 and a head portion 46. The foot and head portions 44 and 46 are shown folded over the bottom portion 40 in FIG. 5 with fold lines at 43 and 45. The side portions 42 are shown unfolded and to the side of the bottom portion 40 along fold lines 48. As shown in FIG. 6, the side portions 42 are folded over the bottom portion 40 so as to create a liquid containment insert that can be positioned over the bottom portion of the structural layer 24 and thus as a liquid containment construction of the body containment bag 20. The liquid containment insert advantageously is created by the multiple fold-formed pockets at both sides, feet area and head area of the containment bag 20 so that liquid can be effectively contained for a week or more as needed. Specifically, side pockets 52, head pocket 54 and feet pocket 56 are created surrounding an open portion 58 central of the side, head and feet pockets 52, 54 and 56. The size of the area 58 can be varied based upon desired pocket sizes. It is also preferable that the insert be connected with the structural layer 24, such as by stitches shown at 50 in the four corners. Any arrangement of stitching is contemplated and/or used with adhesives or laminating techniques, as discussed above, in creating a multi-layer construction including at least a structural layer 24 and a liquid containment layer 22.

It is noted that dimensions of the layers 12 and 14 themselves, as well as the dimensions of the various components such as pockets sizes and the like can be widely varied based upon applications. A standard disposition chamber or resonator provides an internal space that is about 80 inches long by about 29.5 inches wide. Any bag sizes that fit within such interior space and accommodate any body size are contemplated. With larger chamber space, bags could also increase if desired.

Figure 7:
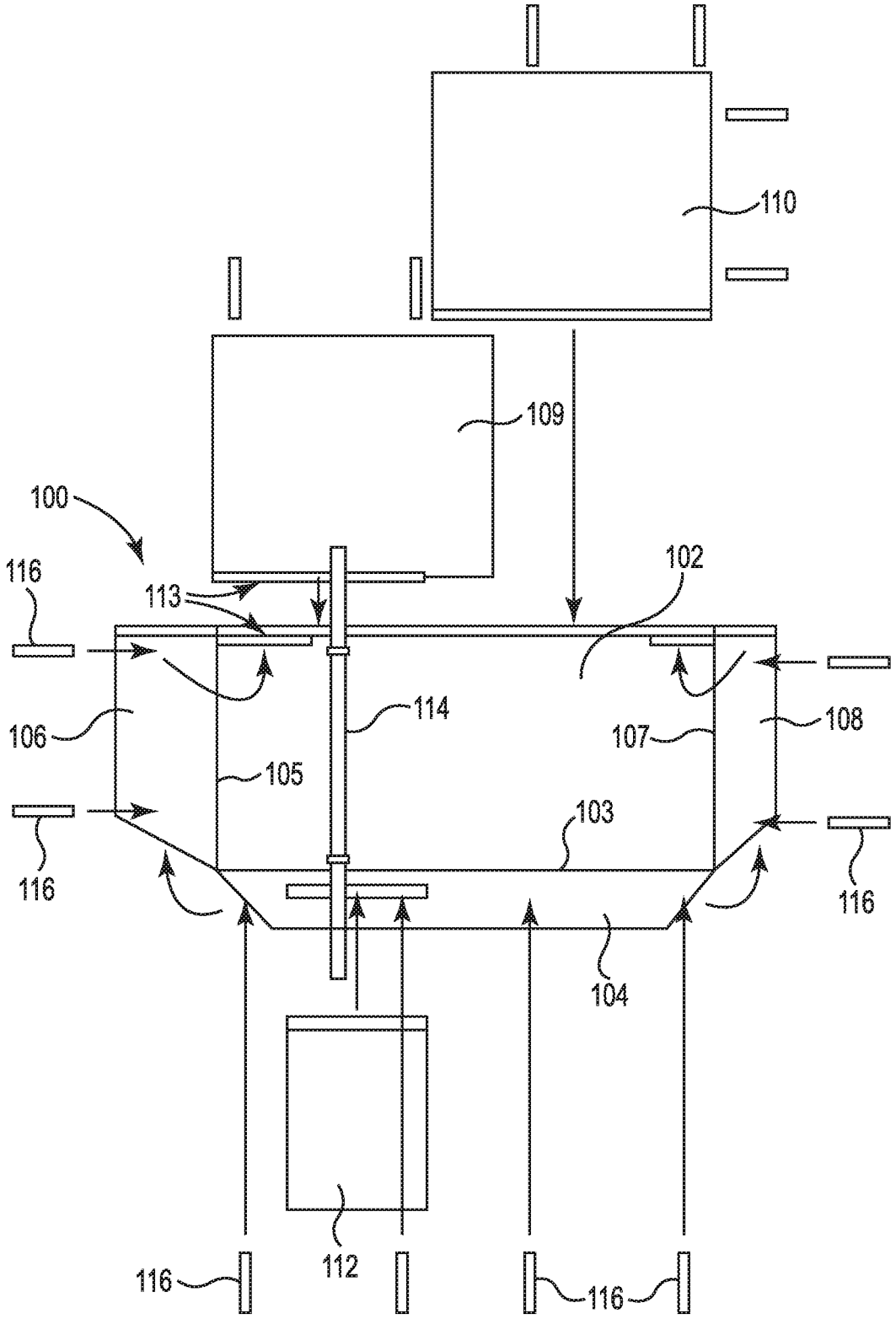
FIG. 7 is a top plan view of components of another embodiment of the present invention for a body containment bag with components exploded from one another to illustrate constructional aspects.

FIG. 7 illustrates another embodiment for a containment bag 100 in accordance with the present invention with components exploded from one another to shown construction aspects. In particular, a bottom panel 102 is connected by a fold line 103 to a body panel 104 along one side and to a head panel 106 and a feet panel 108 along fold lines 105 and 107, respectively, along top and bottom edges. When folded, a body pocket, head pocket and feet pocket are created. Each of these panels preferably comprises both a liquid containment layer and a structural layer, as discussed above, as may be provided as a laminate or other multi-layer construction. Alternatively, a single layer could be utilized if comprised of a material having both liquid impermeability and support strength requirements, as above. An upper cover 109 is shown to be attached along a portion of the bottom panel 102 along a side edge with a portion 111 of the upper cover 109 unconnected to the bottom panel 102 for hand presentation, as discussed below. A lower cover 110 is also to be attached along a remaining portion of the other side of the bottom panel 102 adjacent to the upper cover 109 with a preferable overlap between the upper and lower covers 109 and 110. Upper and lower cover portions 109 and 110 are also preferably constructed of a multi-layer material for structural support and liquid containment. Another upper cover panel 112 is preferably attached to the body panel 104 near its connection with the bottom panel 102 to provide a second upper cover for selectively covering a shoulder of a body for presentation as shown and discussed below. A shoulder strap 114 is also preferably provided for similar purposes as the strap 36 discussed above and as attached to the bottom panel 102. Tie strips 116 are also strategically provided for closure purposes similar to that discussed above with respect to strip 16.

FIGS. 8*a*-8*e* illustrate a construction method of the body containment bag 100 of FIG. 7. It is understood that any seams or connections can be made with integrated panels or by attaching panels by sewing, adhesive, thermal bonding, or the like so long as the principles of usage for bio-cremation discussed above are met.

Figure 8A:
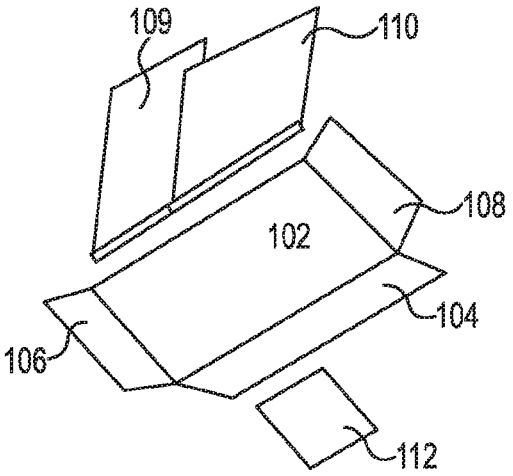
FIGS. 8*a*-8*e* illustrate construction methods of the body containment bag of FIG. 7 including techniques for creating seams or connections and/or fold lines as can be provided with integrated panels or by attaching panels by sewing, adhesive, thermal bonding, or the like in accordance with the present invention.
Figure 8B:
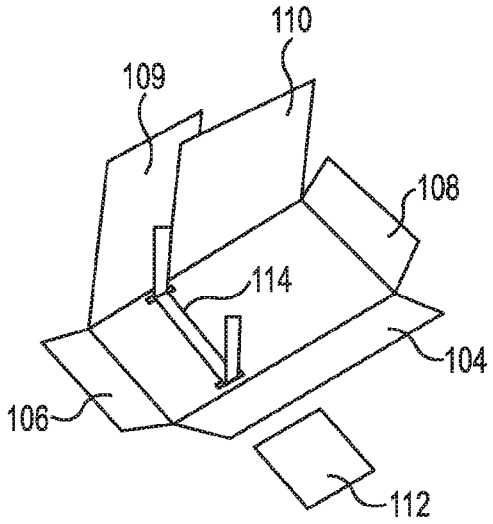
Figure 8C:
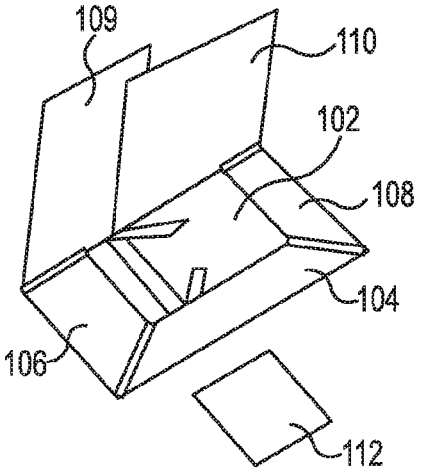
Figure 8D:
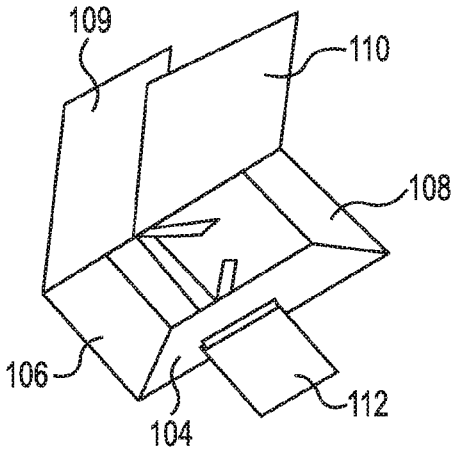
Figure 8E:
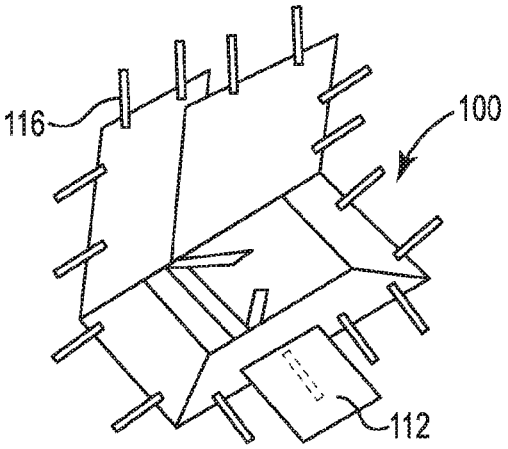

In FIG. 8*a*, the cover portions 109 and 110 are positioned to be sewn, glued, bonded, or otherwise connected to the bottom panel 102 that is also connected with panels 104, 106, and 108 by fold lines. As above, the panel 109 is not completely attached to the bottom panel 102 to allow for hand access. Cover panel 112 is also shown in position for attachment to the bottom panel 102. In FIG. 8*b*, a shoulder strap 114 is positioned and attached, such as by sewing, adhesive, bonding, or the like, to the bottom panel 102 in a position to wrap about the shoulders of a body within the containment bag as constructed. As shown in FIG. 8*c*, the panels 104, 106 and 108 are folded over the bottom panel 102 and then preferably attached to one another as shown along side edges to create a side, head and feet pockets, respectively. The side edges of the panels may be trimmed to minimize overlap for seaming to one another. FIG. 8*d* illustrates the further attachment of the upper panel 112 at a preferred location along the side panel 104 for positioning relative to the upper portion of a body as discussed above. FIG. 8*e* illustrates the preferred positioning of closure tabs 116 as may be provided on a combination of the bottom panel 102 and the various cover panels 109 and 110.

Figure 9A:
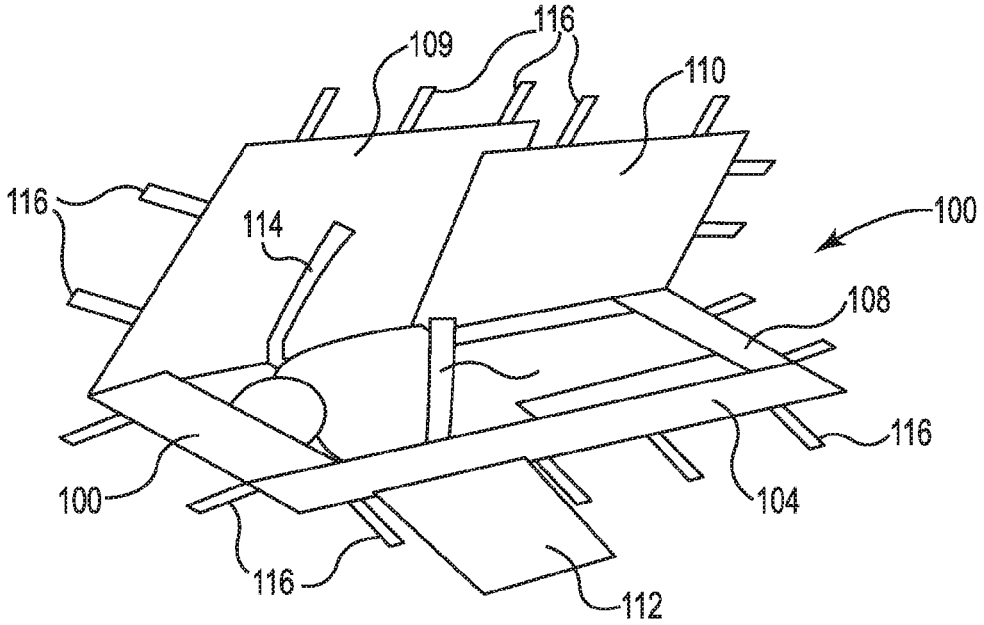
FIGS. 9*a*-9*s* illustrate aspects of securing a body in place, closing a body containment bag along with certain specific body presentation options. Flaps of a body containment bag of the present invention can be manipulated during the closure procedure and presentation procedures to allow for total body containment and to permit versatility in body presentation in accordance with aspects of the present invention.
Figure 9B:
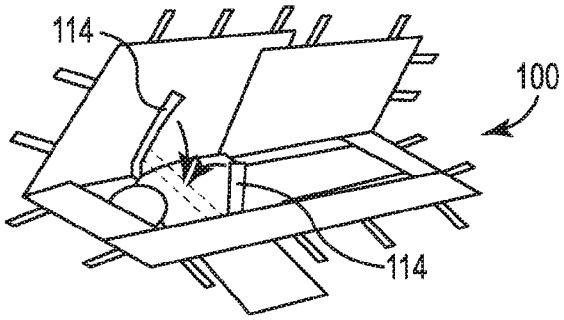
Figure 9C:
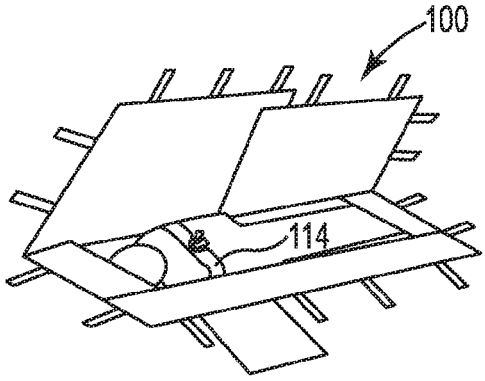
Figure 9D:
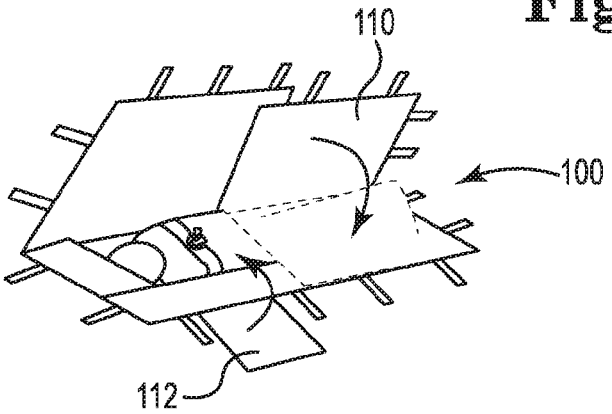
Figure 9E:
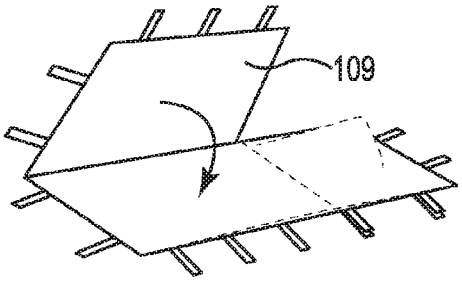
Figure 9F:
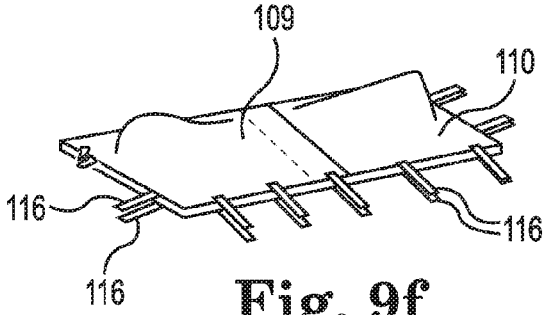
Figure 9G:
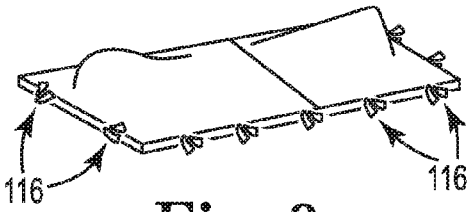
Figure 9H:
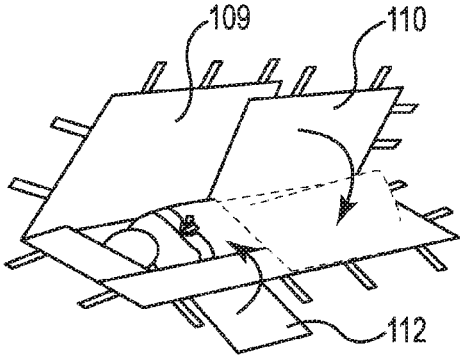
Figure 9I:
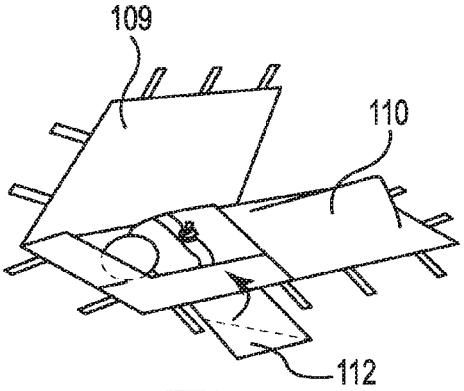
Figure 9J:
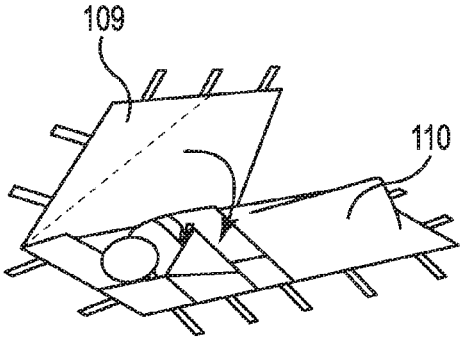
Figure 9K:
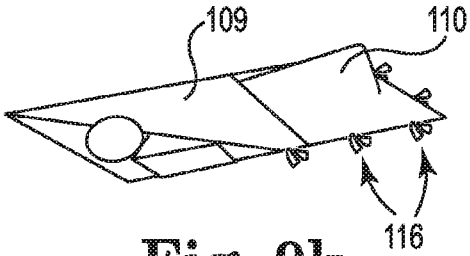
Figure 9L:
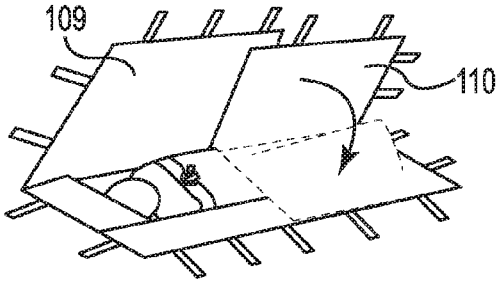
Figure 9M:
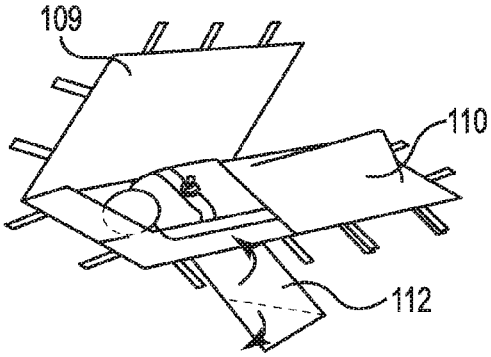
Figure 9N:
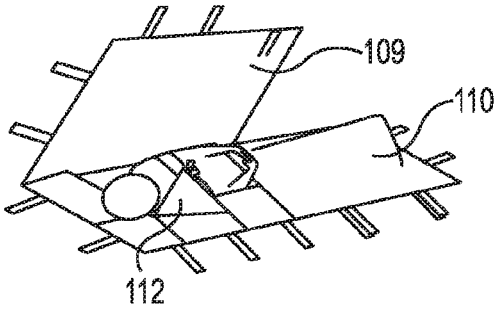
Figure 9O:
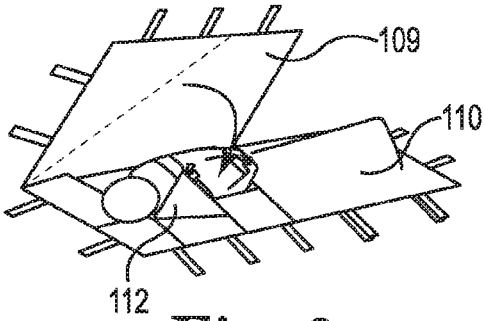
Figure 9P:
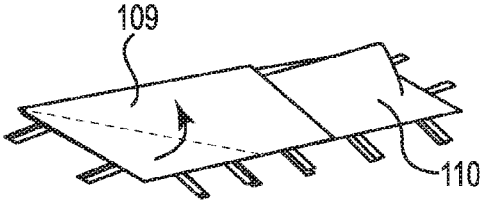
Figure 9Q:
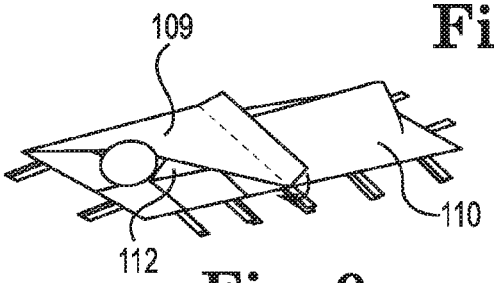
Figure 9R:
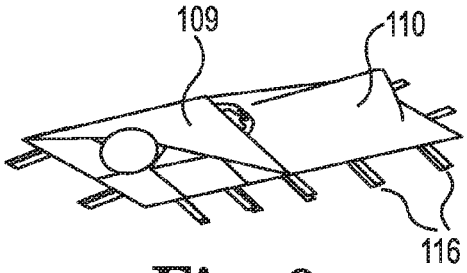
Figure 9S:
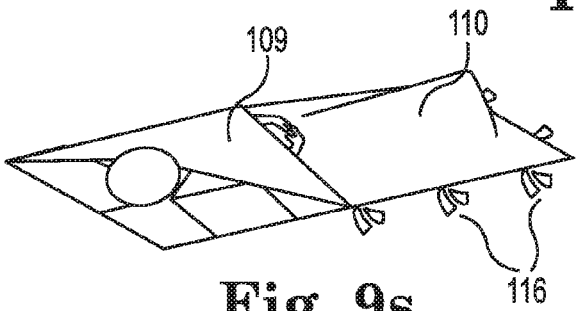

FIGS. 9*a*-9*s* illustrate aspects of securing a body in place, closing a body containment bag 100 along with various body presentation options. As clearly illustrated, each of the flaps 190, 110 and 112 can be manipulated during a closure procedure and various presentation procedures to allow for total body containment and to permit versatility in body presentation, both important aspects of the present invention.

Specifically, in FIG. 9*a*, a body is illustrated positioned within the body containment bag 100 with a head, feet and side positioned within head, feet and side pockets, respectively, as formed by the panels 106, 108 and 104, respectively. The shoulder strap 114 is positioned to wrap about the body at its shoulders for restraint of the body within the bag 100. In FIG. 9*b*, a body is secured within the bag 100 by pulling the straps 114 tight and tying them together. This secures the arms to the body to keep them in place. FIG. 9*c* shows the body as secured within the bag 100. In FIG. 9*d*, a step of covering the bottom of a body is illustrated by folding the cover panel 110 over the legs of the body and a step of partially covering an upper portion of the body by the panel 112. In FIG. 9*e*, a subsequent step of folding the other upper panel 109 over the upper portion of the body is shown. At this point, the body is completely positioned within and covered by the panels of the body containment bag 100 according to the illustrated design. In FIG. 9*f*, the step of closing the body containment bag is shown as the closure strips 116 are tied together. FIG. 9*g* illustrates the body containment bag 100 fully closed with all closure strips 116 tied and in place as may also be utilized for carrying the enclosed body.

FIGS. 9*h*-9*s* shown body presentation variations. In FIG. 9*h*, the body is covered by lower body cover 110, similar to FIG. 9*d* above. The shoulder of the body is covered as in FIG. 9*i* by cover 112, but preferably with a fold as shown in dashed line, which results in a body covering as shown in FIG. 9*j*. The cover panel 109 is preferably then folded along the dashed line in FIG. 9*j* and covered over the body to present the body head as shown in FIG. 9*k*. This completes a body head presentation in accordance with the construct of a body containment bag 100 of the present invention.

In FIGS. 9*l*-9*s*, a body presentation is illustrated where a body head and hands can be presented. Similar to that just above, FIGS. 9*l* and 9*m* show a covering procedure by panels 110 and 112, which panel 112 folded as shown. FIG. 9*n* shows the body with panels 110 and 112 in covering positions and with the body elbows bent and with its hands positioned over a top edge of the panel 110. In FIG. 9*o*, the panel 109 is folded as shown and positioned to cover the body left shoulder and torso. FIG. 9*p* shows the panel 109 folded back along the triangular fold line to uncover the body head as shown in FIG. 9*q*. FIG. 9*q* also illustrates a further fold line as a dashed line space a distance from the lower edge of the panel 109. This fold line is facilitated by the portion of the panel 109 that is left unattached to the bottom panel 102, as discussed above. As shown in FIG. 9*r*, the panel portion can be folded back to expose the body hands are they were previously positioned over the top edge of the panel 110. The panel portion can preferably be folded under the panel 109 as shown and tucked about the body wrists. Lastly, FIG. 9*s* shows the body in the presentation configuration with the body head and hands presented for viewing and with the body containment bag 100 fully closed. Preferably, each of the closures are tucked in between the panels for final presentation.

It is also noted that with certain disposition chambers that are in commercial use, a head support is sometimes provided to more effectively dissolve internal organs of the head effectively and to prevent the head from bobbing within the container. The support is a cage that maintains the head in position for directing solution directly to the head. A bag design of the present invention, as described above, is further advantageous in that the body can go into the chamber within the body bag 10 having the head uncovered to facilitate this process.

FIGS. 10-13 show another embodiment of the present invention utilizing structural material combined with liquid containment material and one or more closures that are effectively usable for bio-cremation based upon criteria discussed above for a suitable body containment bag for decomposition by alkaline hydrolysis. In this embodiment, a potentially cheaper and lighter weight version is created by minimizing the use of structural material.

Figure 10:
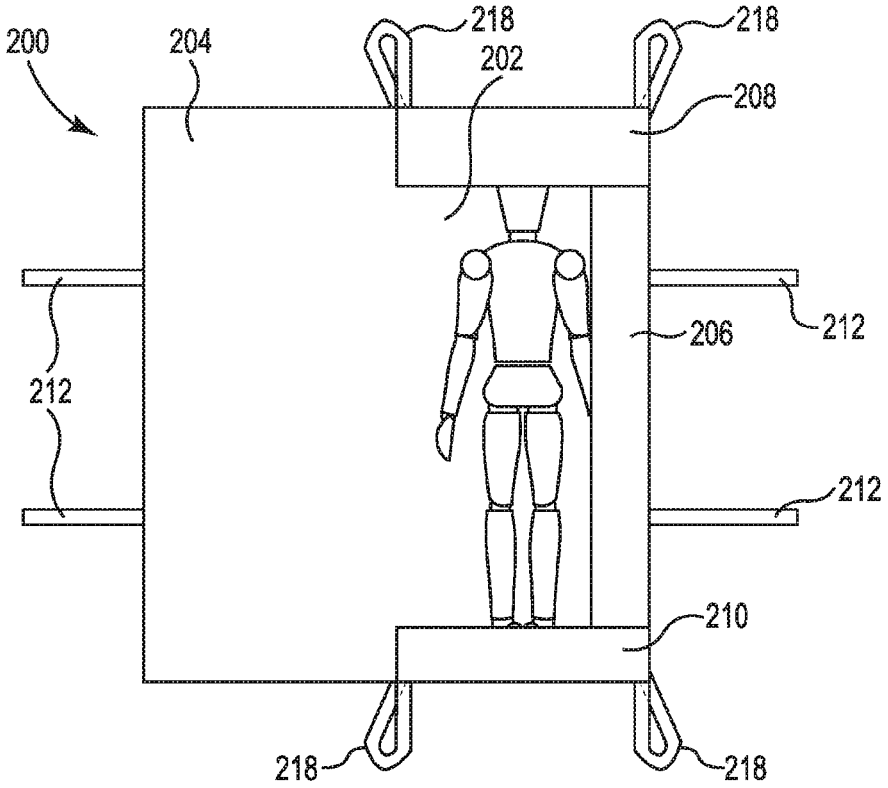
FIG. 10 is a top plan view of another embodiment of a body containment bag of the present invention utilizing structural material combined with liquid containment material and one or more closures that are effectively usable for bio-cremation by alkaline hydrolysis.
Figure 11:
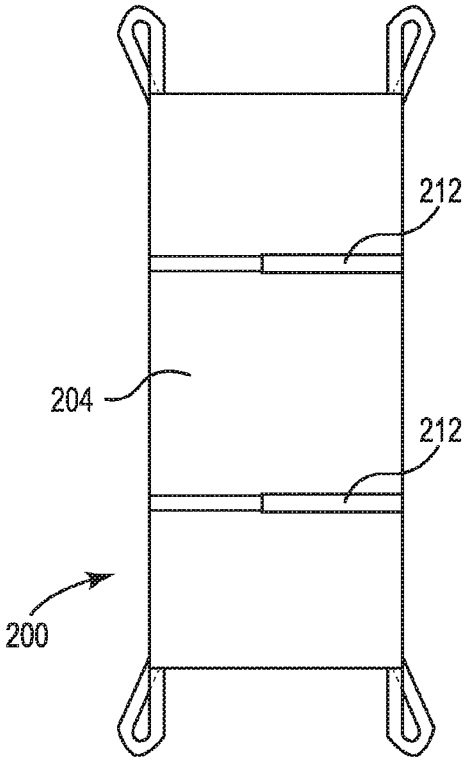
FIG. 11 is a top plan view of the body containment bag of FIG. 10 with the body containment bag and closures thereof closed.
Figure 12:
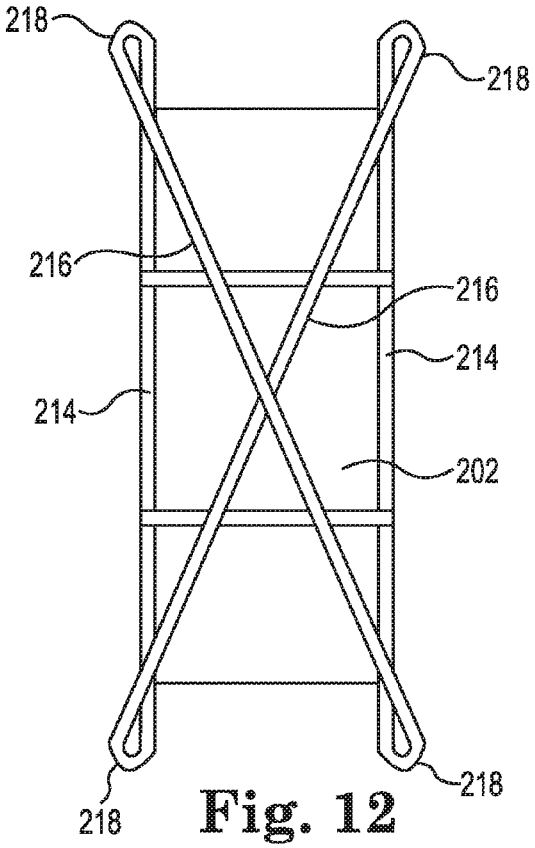
FIG. 12 is a bottom plan view of the body containment bag of FIG. 10 with the body containment bag and closures thereof closed.

In FIG. 10, a layer of liquid impermeable material can be used as the primary material of a body containment bag 200. A liquid containment layer is divided into a back portion 202, a cover portion 204, a body pocket forming portion 206, a head pocket forming portion 208 and a feet pocket forming portion 210. Like the embodiments discussed above, these portions can create an effective pocketed containment bag, and these respective panels can be created as a single material layer or from multiple panels attached together, such as by sewing, adhesives, thermal bonding, or the like. By utilizing a liquid impervious material, as discussed above, for this construct preferably including head, side and feet pockets, as also discussed above, liquid containment can be achieved. However, body transport is compromised by this design. In order to thus provide for sufficient body transport and strength for support, a structural support material is preferably strategically placed along the liquid impervious material, such as illustrated and discussed below.

Bag closure straps 212 preferably extend along a back surface of the bottom panel 202 at plural longitudinally space locations to provide closure to the bag 200 and to secure the body in position at both a shoulder position and an upper leg position. The ends of the straps 212 extend from the edges of the bottom and cover panels 202 and 204 so as to be tie-able to one another for this purpose. Any number of such straps 212 are contemplated for securing a body and providing structural support as desired.

Structural support is further strategically provided by a pair of edge strips 214 and preferably a further pair of criss-cross strips 216 as shown. Ends of these strips can be connected with one another, such as by stitching, adhesive, or thermal bonding for creating loop carry handles 218 at each corner. The result is a body containment bag 200 that is effective for support and transport along with liquid containment and that is usable with a bio-cremation process as discussed above. Controlling the thickness of the reinforcing structural material, especially at areas of multiple overlaps is needed to make sure there is fully decomposition of the bag 200 within the time constraints of an alkaline hydrolysis process.

Figure 13:
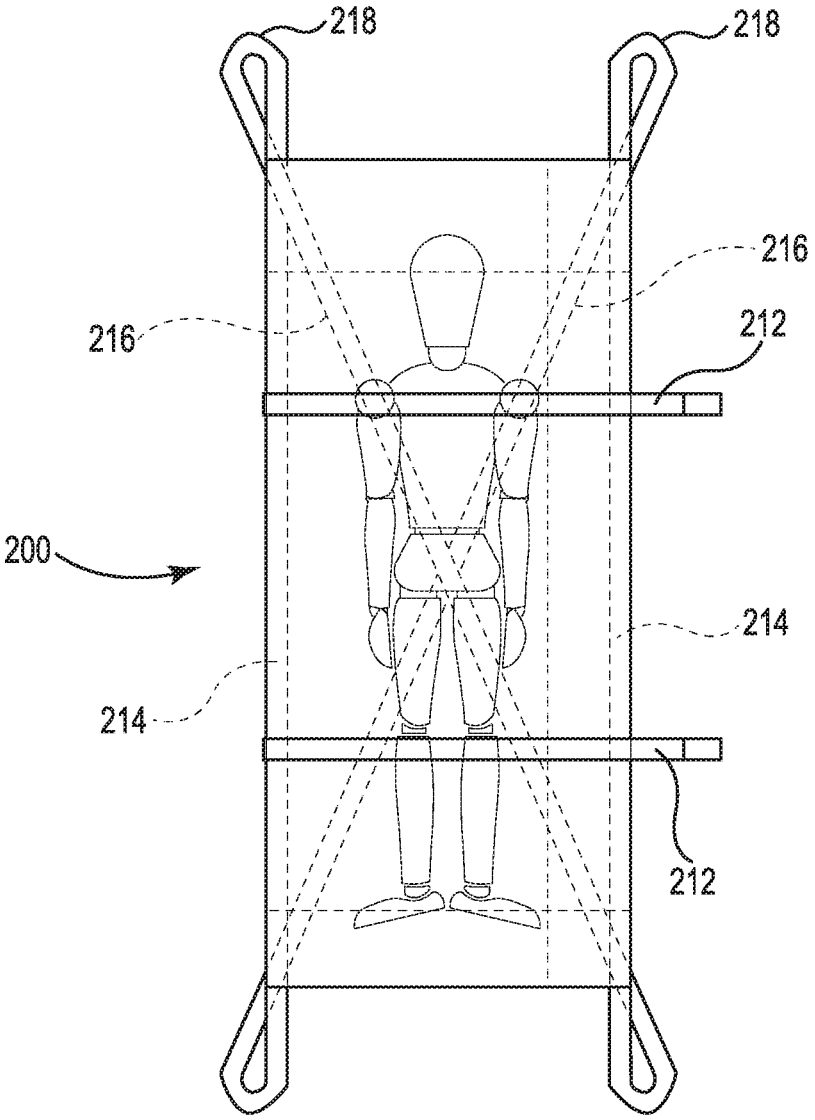
FIG. 13 is a top plan view similar to FIG. 11, with a body illustrated in solid lines as the body is positioned with respect to the structural materials for providing body support.

FIG. 10 illustrates the body in position within head, side and feet pockets formed by the bottom panel 202 along with panels 208, 206 and 210, respectively. FIG. 13 illustrates such a body position with the body containment bag 200 and with respect to the structural support elements including the closure straps 212, the edge strips 214 and the criss-cross strips 216. As shown, the structural support by the strips 212, 214 and 216 together strategically support a body with the bag for transport as is also facilitated by the loop handles 218. Specifically, strategic structural support is provided by adding the plural strips of the structural layer along one or more edge portions and to across a body support region of the bottom panel of the liquid containment layer. Most preferably, such strip layers of structural material extend along both longitudinal edges and criss-crossing across the body support region.

It is contemplated that many variations can be made to constructions of body containment bags in accordance with the present invention. Many different cover and flap arrangements are contemplated with any number of panels with the basic aspect of providing liquid containment as desired and to provide structural support for body transport. Arrangements for body presentation can be made based upon different cover panel shapes, sizes and designs as well.

The invention claimed is:

1. A body containment bag comprising structural material combined with liquid containment material and at least one closure operatively connected with the liquid containment material for closing the body containment bag, wherein the body containment bag is effectively usable for bio-cremation during which all components of the body containment bag can effectively decompose by alkaline hydrolysis, the body containment bag comprising the structural material and a layer of the liquid containment material with the structural material overlaying at least a portion of the layer of the liquid containment material and the structural material being external to the layer of the liquid containment material, wherein the layer of the liquid containment material is adapted to receive therein a deceased body and to be closed by the at least one closure, and wherein the structural material comprises plural strip layer portions that are connected with and overlay the at least a portion of the layer of liquid containment material and positioned so as to extend along at least one side edge and across a body support region of a bottom panel of the layer of liquid containment material of the body containment bag for body support for transport.

2. The body containment bag of claim 1, wherein the plural strip layer portions include side edge strip layer portions and portions that form a criss-cross pattern across the bottom panel of the body containment bag that are connected with the side edge strip layer portions at corners of the body containment bag and forming loop handles at the corners of the body containment bag.

3. The body containment bag of claim 2, wherein the liquid containment material is formed to create a head pocket, at least one side pocket, and a feet pocket for receiving a head, side, and feet of the deceased body, respectively when positioned within the body containment bag.

4. The body containment bag of claim 3, further comprising a plurality of closures positioned about at least a portion of the periphery of the body containment bag, wherein each closure can be independently closed to close off a portion of the body containment bag.

5. The body containment bag of claim 2, wherein the structural material is laminated to the layer of liquid containment material.

6. The body containment bag of claim 5, wherein the bottom panel of the body containment bag is generally rectangular and is connected with a head panel, a side panel and a feet panel provided along three edges of the bottom panel to create a head pocket, a side pocket and a feet pocket.

* * * * *